US010797424B2

(12) United States Patent
Hsu

(10) Patent No.: US 10,797,424 B2
(45) Date of Patent: Oct. 6, 2020

(54) ELECTRICAL CONTACT

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Shuo-Hsiu Hsu, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/395,254

(22) Filed: Apr. 26, 2019

(65) Prior Publication Data

US 2019/0334272 A1 Oct. 31, 2019

(30) Foreign Application Priority Data

Apr. 27, 2018 (CN) ..... 2018 2 0615657 U
Apr. 27, 2018 (CN) ..... 2018 2 0624878 U

(51) Int. Cl.
*H01R 12/00* (2006.01)
*H01R 13/24* (2006.01)
(Continued)

(52) U.S. Cl.
CPC ..... *H01R 13/2435* (2013.01); *H01R 12/714* (2013.01); *H01R 13/2428* (2013.01);
(Continued)

(58) Field of Classification Search
CPC ..... H01R 13/2435; H01R 33/94; H01R 13/2428; H01R 12/714; H01R 13/646;
(Continued)

(56) References Cited

U.S. PATENT DOCUMENTS 6,824,396 B2 11/2004 Koopman et al.
7,052,284 B2 * 5/2006 Liao ..... H01R 13/2435 439/66

(Continued)

FOREIGN PATENT DOCUMENTS

CN 103311695 A 9/2013
CN 2641846 Y 9/2014

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical contact for connecting a chip module to a print circuit board, the electrical contact comprises a main body, an upper elastic arm and a lower mounting arm extending upwardly from the main body, and a lower elastic arm and a lower mounting arm extending downwardly from the main body. The upper mounting arm is disposed at the downside of the upper elastic arm and forms a space therebetween; the lower mounting arm is disposed at the downside of the lower elastic arm and forms a space therebetween. The upper elastic arm and the lower elastic arm are respectively deformed by the chip module and print circuit board to resist to the upper mounting arm and lower mounting arm, thereby shortening the current path between the chip module and the print circuit board for improving the high frequency performance of an electrical connector.

20 Claims, 13 Drawing Sheets

(51) Int. Cl.
*H01R 33/94* (2006.01)
*H01R 12/71* (2011.01)
*H01R 13/646* (2011.01)
*H01R 33/74* (2006.01)

(52) U.S. Cl.
CPC ..... *H01R 13/646* (2013.01); *H01R 33/74* (2013.01); *H01R 33/94* (2013.01)

(58) Field of Classification Search
CPC .... H01R 33/74; H01R 13/41; H01R 12/7082; H01R 12/7076
USPC ..... 439/626, 826, 66, 83
See application file for complete search history.

(56) References Cited

U.S. PATENT DOCUMENTS 7,390,195 B2 * 6/2008 Liao ..... H01R 13/2435 439/66
7,559,811 B1 * 7/2009 Polnyi ..... H01R 4/4809 439/591
7,625,217 B1 * 12/2009 Liao ..... H01R 12/714 439/66
7,878,818 B2 * 2/2011 Cheng ..... H05K 7/1069 439/591
7,972,144 B2 * 7/2011 Chang ..... H01R 4/02 439/66
7,988,501 B2 * 8/2011 Chang ..... H05K 7/1069 439/751
8,366,453 B2 * 2/2013 Chang ..... H01R 12/58 439/66
8,523,615 B2 * 9/2013 Luo ..... H01R 12/7082 439/660
9,437,948 B2 * 9/2016 Ju ..... H01R 12/7076
10,199,756 B2 * 2/2019 Ju ..... H01R 13/2457
2009/0269950 A1 * 10/2009 Liao ..... H01R 13/2435 439/66
2010/0055944 A1 * 3/2010 Chang ..... H01R 4/02 439/78
2010/0055997 A1 * 3/2010 Szu ..... H01R 13/193 439/861
2011/0014816 A1 * 1/2011 Fan ..... H01R 12/57 439/626
2011/0032681 A1 * 2/2011 Chang ..... H05K 3/308 361/747
2011/0111607 A1 * 5/2011 Chang ..... H01R 12/58 439/70
2011/0151723 A1 * 6/2011 Liao ..... H01R 12/57 439/660
2012/0028502 A1 * 2/2012 Yeh ..... H01R 12/57 439/626
2012/0129406 A1 * 5/2012 Hsu ..... H01R 12/58 439/701
2013/0237066 A1 * 9/2013 Yeh ..... H01R 13/2457 439/65
2014/0024231 A1 * 1/2014 An ..... H01R 12/52 439/68
2014/0030925 A1 * 1/2014 Terhune, IV ..... H01R 12/714 439/626
2019/0334272 A1 * 10/2019 Hsu ..... H01R 33/74

FOREIGN PATENT DOCUMENTS

CN 107134664 A 9/2017
TW M437555 9/2012
TW M366195 10/2019

* cited by examiner

ELECTRICAL CONTACT

BACKGROUND OF THE INVENTION

1. Field of the Invention

The present invention relates generally to an electrical contact, and more particularly to the electrical contact connecting a chip module to a print circuit board.

2. Description of Related Arts

U.S. Pat. No. 6,824,396 discloses an electrical connector includes an insulative housing and a conductive terminal, the conductive terminal includes a holding portion mounted to the insulative housing, and an upper elastic arm and a lower elastic arm respectively connected to upper and lower ends of the holding portion. The upper and lower elastic arms are respectively connected the chip module and the print circuit board, when the chip module is pressed to the conductive terminal, the conductive terminal connects the chip module and the circuit board to achieve an electrical conduction. Because of the transmitting speed of the high frequency signal of the electrical connector is continuously require improved, however, the upper and lower elastic arms of such conductive terminals have to be designed in a curved long arm shape due to the abutment demand, which may cause the current path of the conductive terminal becoming very long, thereby affecting its high frequency characteristics and limiting its transmission rate.

Hence, an electrical contact with improved structure is desired.

SUMMARY OF THE INVENTION

To achieve the above object, an electrical contact for connecting a chip module to a print circuit board, the electrical contact comprises a main body, an upper elastic arm and a lower mounting arm extending upwardly from the main body, and a lower elastic arm and a lower mounting arm extending downwardly from the main body. The upper mounting arm is disposed at the downside of the upper elastic arm and forms a space therebetween; the lower mounting arm is disposed at the downside of the lower elastic arm and forms a space therebetween. The upper elastic arm and the lower elastic arm are respectively deformed by the chip module and print circuit board to resist to the upper mounting arm and lower mounting arm, thereby shortening the current path between the chip module and the print circuit board for improving the high frequency performance of an electrical connector.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
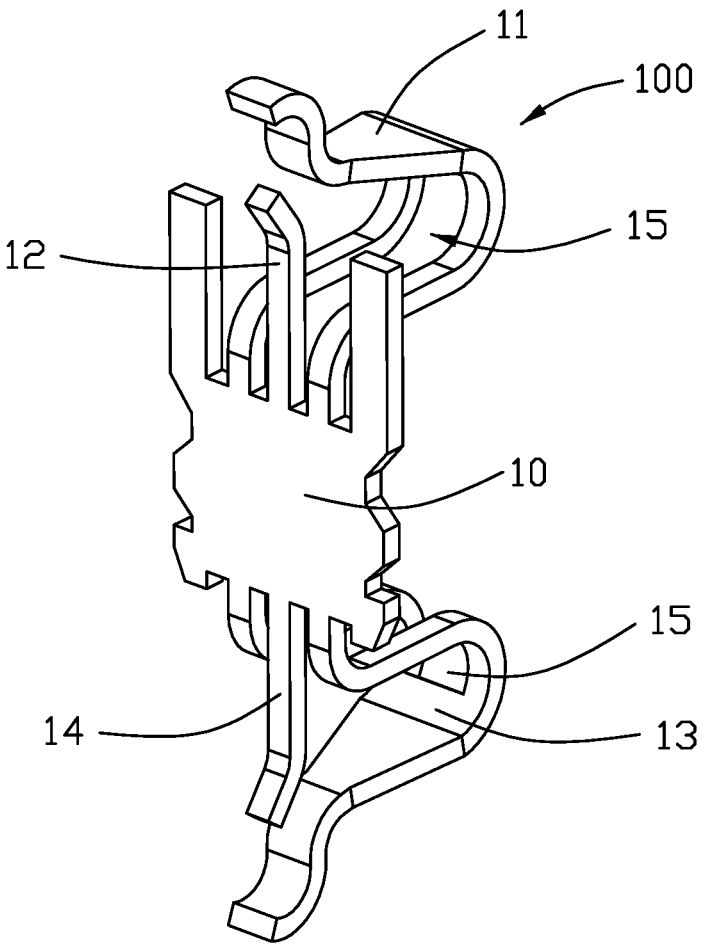
FIG. 1 is a perspective view of the electrical contact of a first preferred embodiment of the present invention.
Figure 2:
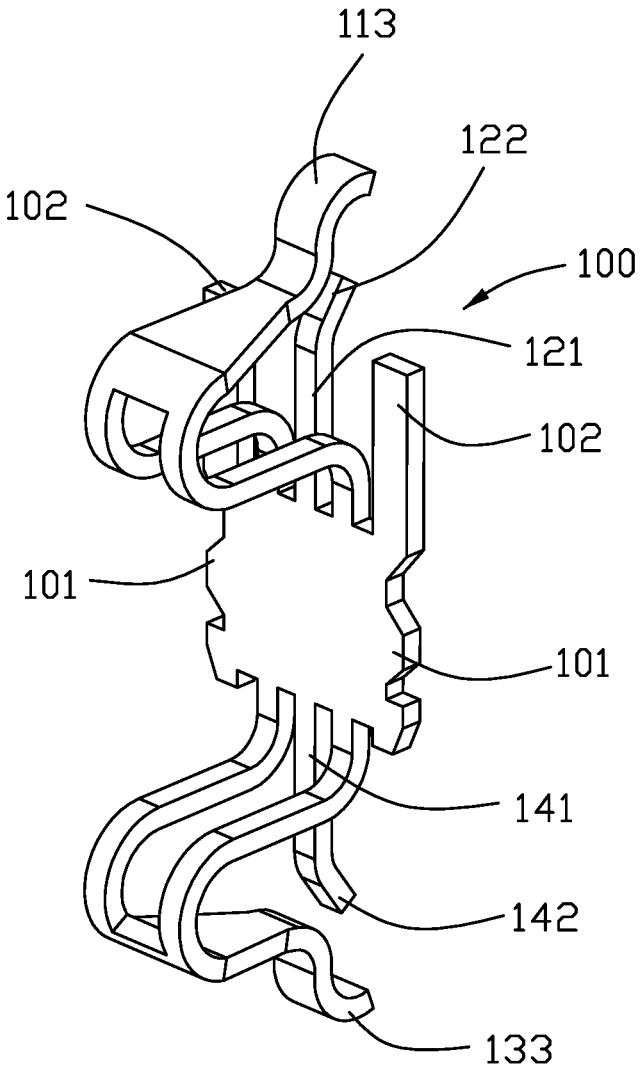
FIG. 2 is another perspective view of the electrical contact as shown in FIG. 1.
Figure 3:
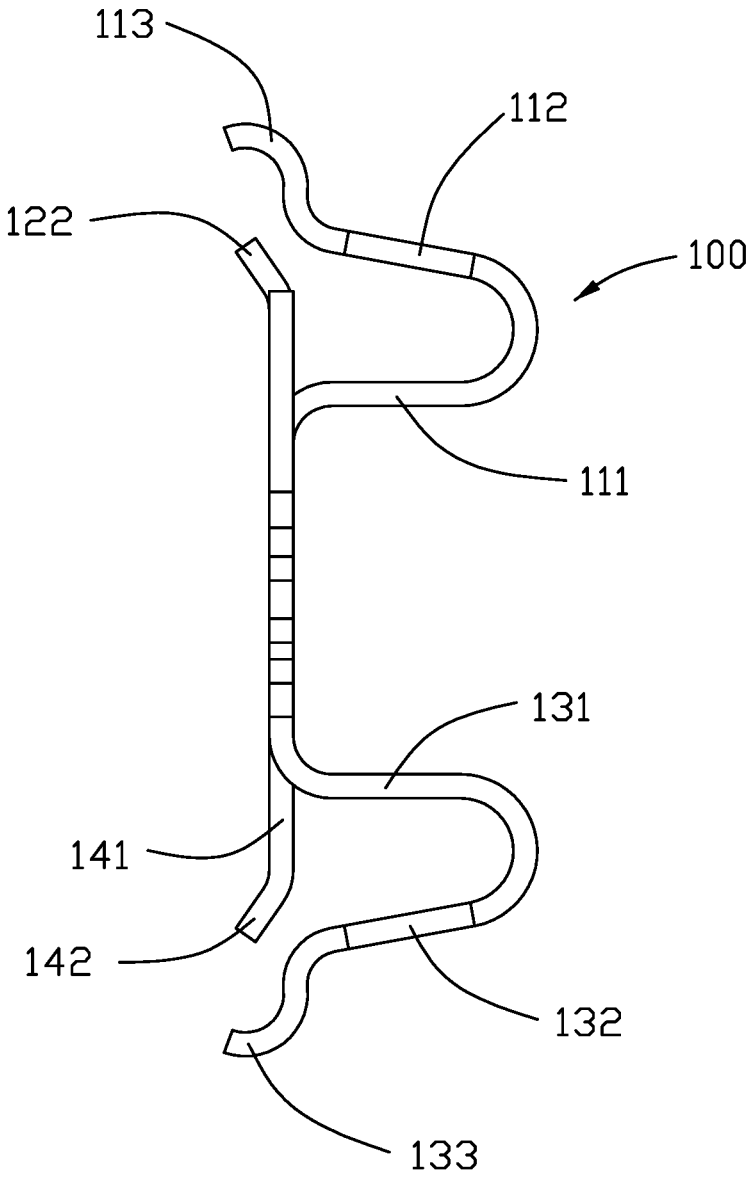
FIG. 3 is another perspective view of the electrical contact as shown in FIG. 1.

Referring to FIG. 1-4, an electrical contact 100 for use within an electrical connector to electrically connect a chip module or CPU (Central Processing Unit) 102 to a printed circuit board 101, includes an main body 102, an upper elastic arm 11 and a lower mounting arm 12 extending upwardly from said main body 10, and a lower elastic arm 13 and a lower mounting arm 14 extending downwardly from said main body 10.

The upper elastic arm (unit) 11 includes a first bending portion 111 extending from the upper end of the main body 10 toward to the direction away from the main body 10, a second bending portion 112 bending upwardly from the first bending portion 111, an arc-shaped upper contacting portion 113 extending upwardly from the second bending portion 112 to the upside of the main body 10; and the lower elastic arm (unit) 13 includes a third bending portion 131 extending from the downside of the main body 10 to the direction away from the main body 10, a forth bending portion 132 bending downwardly from the third bending portion 131, and an arc-shaped lower contacting portion 133 extending downwardly from the forth bending portion 132 to the downside of the main body 10, the upper and lower elastic arms 11,13 are U-shaped with an opening facing to the plane where the main body 10 located. Both the upper and lower elastic arms 11,13 define a slit 15 passing through the upper and lower end of the main body 10, the upper and lower mounting arms 12,14 are disposed at the slits 15 of upper and lower elastic arms 11,13 and protruding out of the corresponding slits 15.

The main body 10 includes a plurality of barbs 101 protruding from its left and right sides, and a pair of carriers 102 extending vertically from the upper end of the main body 10, said two carriers 102 are located on the two sides of the upper arm 11.

The upper mounting arm 12 comprises a first extending portion 121 extending vertically and an upper abutting portion 122 extending obliquely from the upper end of the first extending portion 121, the lower mounting arm 14 comprises a second extending portion 141 extending vertically and a lower abutting portion 142 extending obliquely from the lower end of the second extending portion 141.

The upper and lower abutting portions 122,142 and the upper and lower contacting portions 113,133 are set interval and disposed at the other side of the plane where the main body 10 located. The length of the upper and lower mounting arms 12,14 are shorter than the length of the corresponding upper and lower elastic arms 11,13.

The upper elastic arm 11 and the lower elastic arm 13 are symmetrically disposed at the center of the main body 10, and the upper mounting arm 12 and the lower mounting arm 14 are symmetrically disposed at the center of the main body 10, thereby being good for the symmetrically elastic deformation of the upper and lower elastic arms 11,13 and lengthen the service life of the electrical contact 100.

Figure 4:
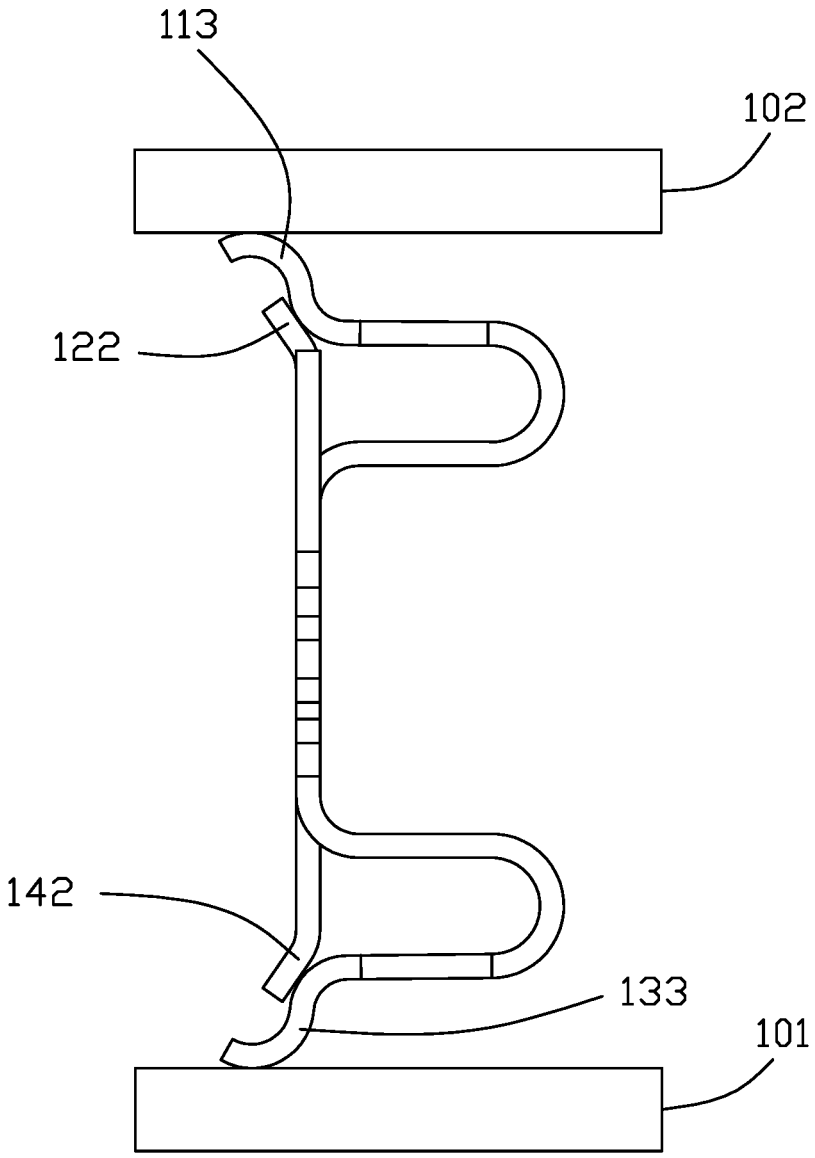
FIG. 4 is a perspective view of the electrical contact, wherein the electrical contact is deformed by the chip module and print circuit board.
Figure 5:
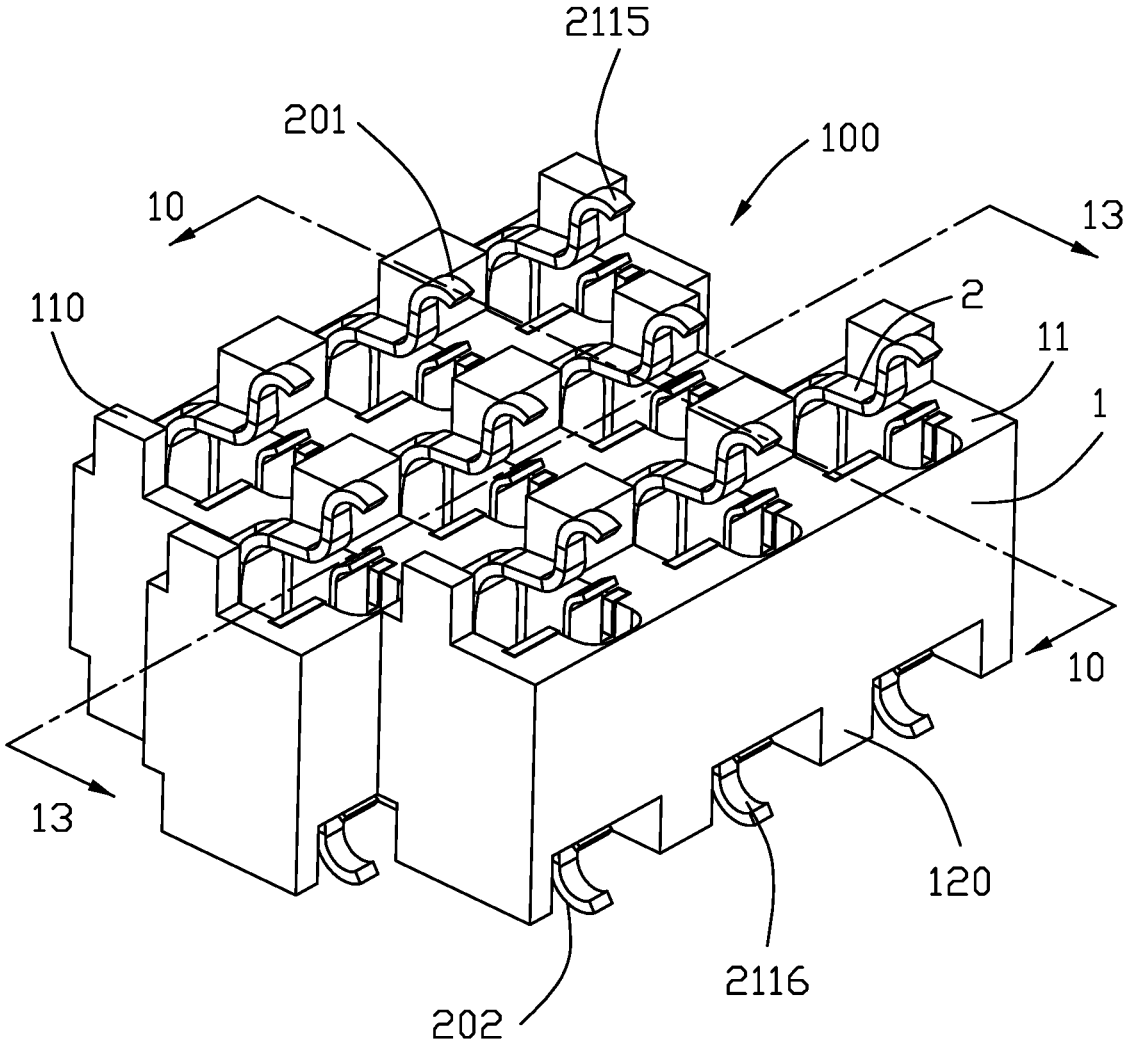
FIG. 5 is a perspective view of the electrical connector of a second preferred embodiment of the present invention.
Figure 6:
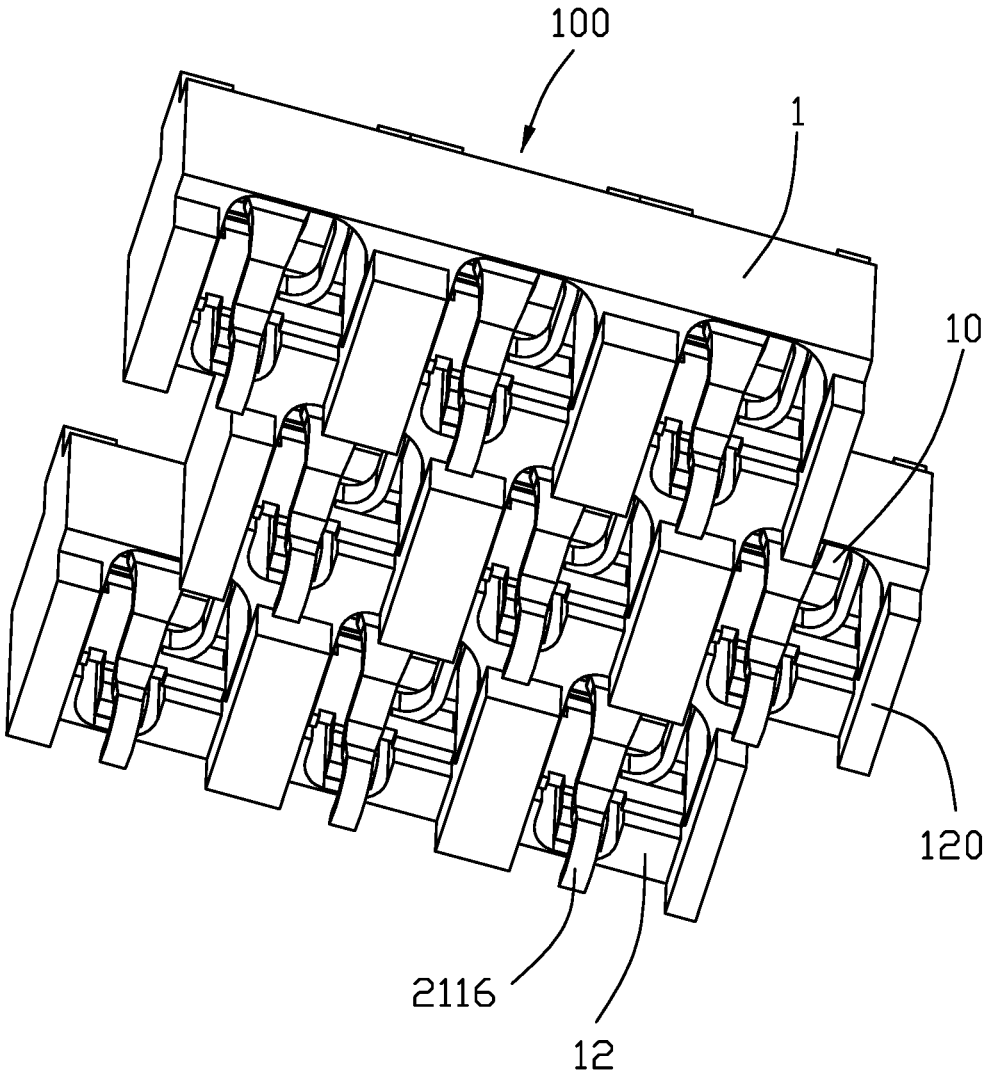
FIG. 6 is another perspective view of the electrical connector of FIG. 5.
Figure 7:
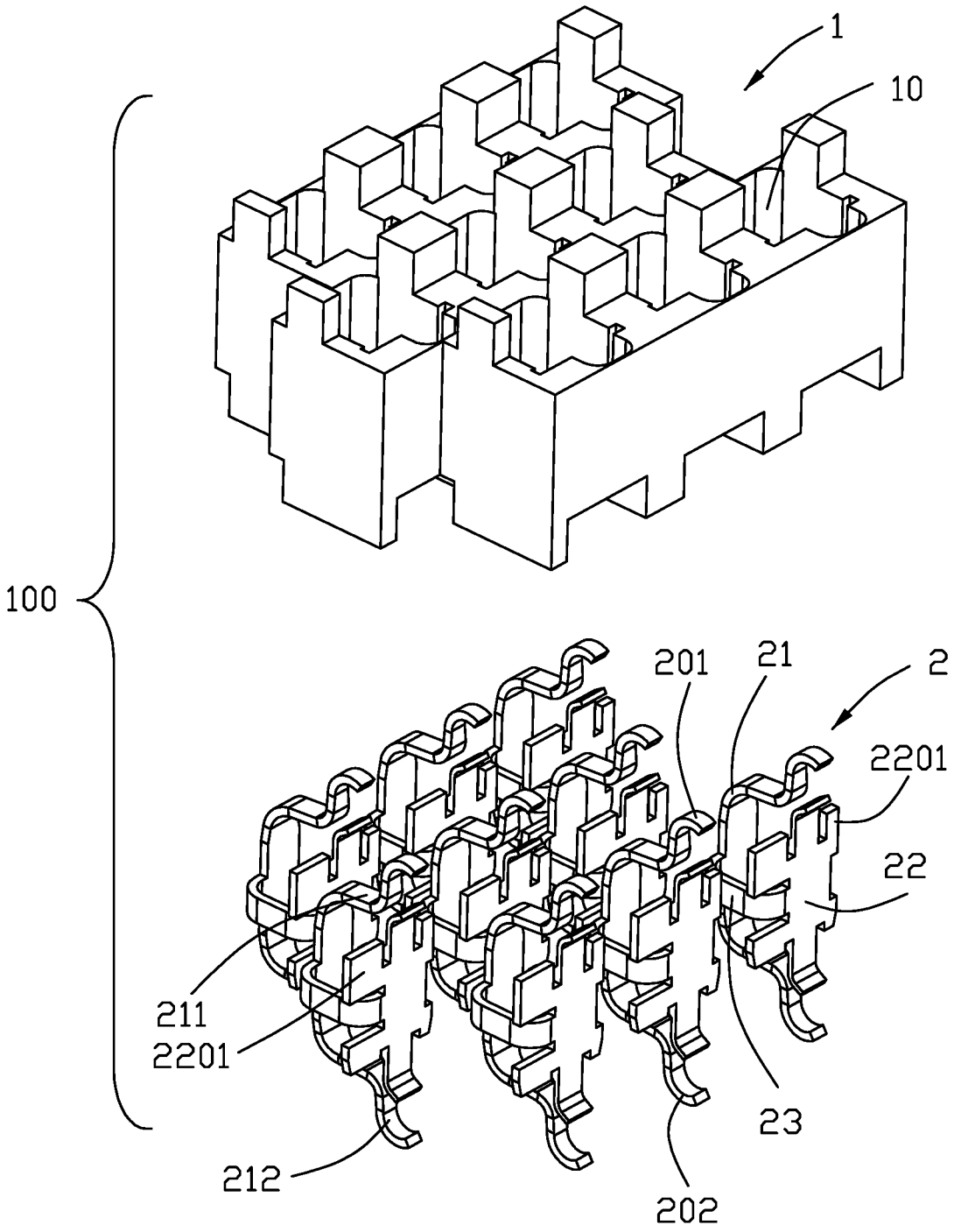
FIG. 7 is an exploded perspective view of the electrical connector of FIG. 5.
Figure 8:
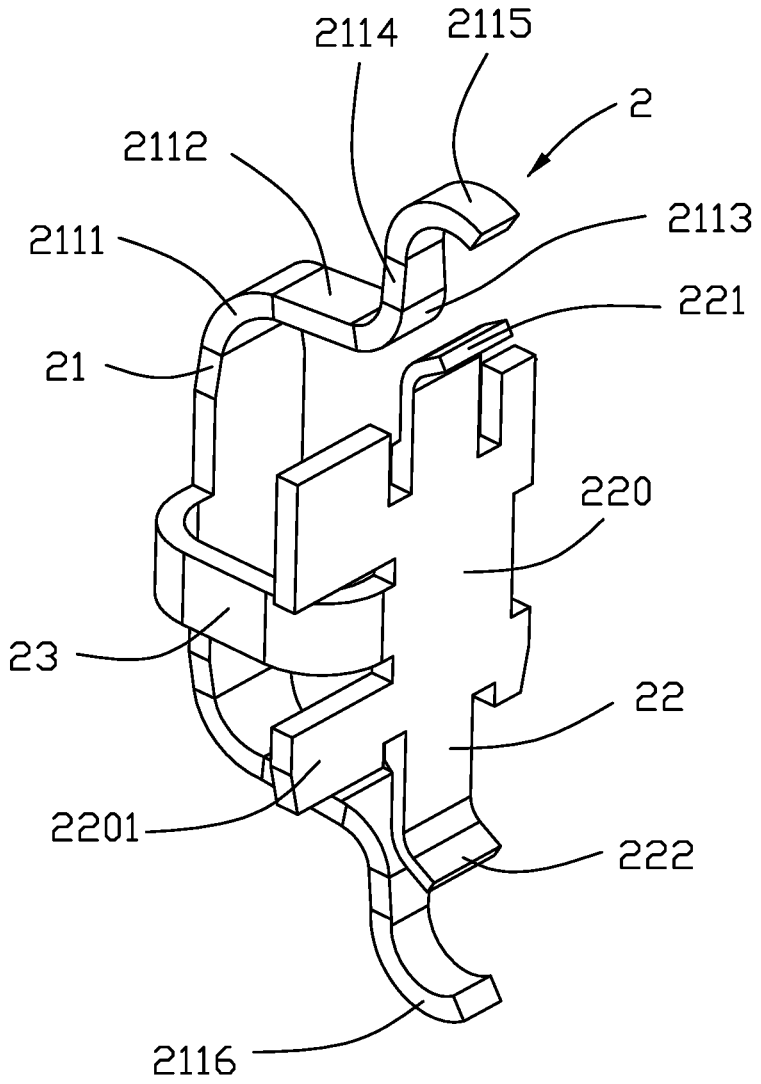
FIG. 8 is a perspective view of the electrical contact of the electrical connector of FIG. 5.
Figure 9:
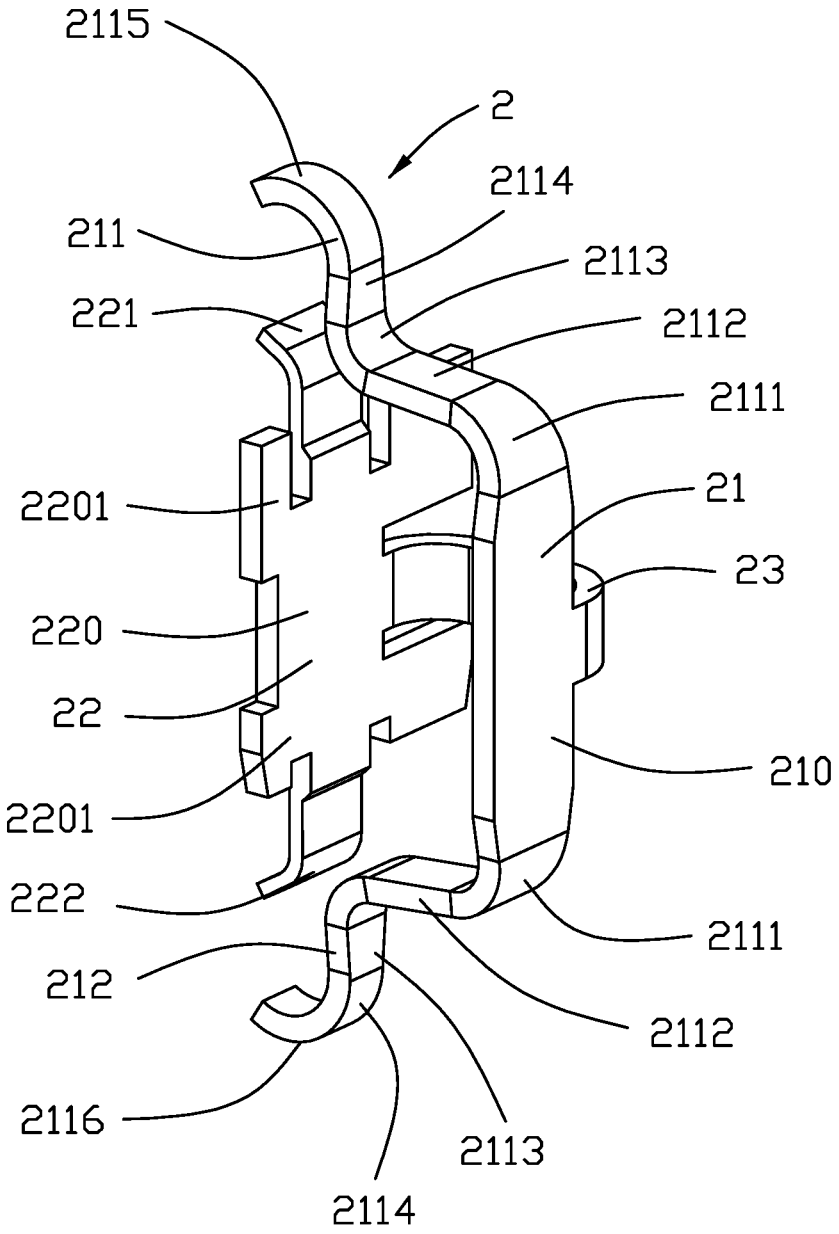
FIG. 9 is another perspective view of the electrical contact of the electrical connector of FIG. 8.
Figure 10:
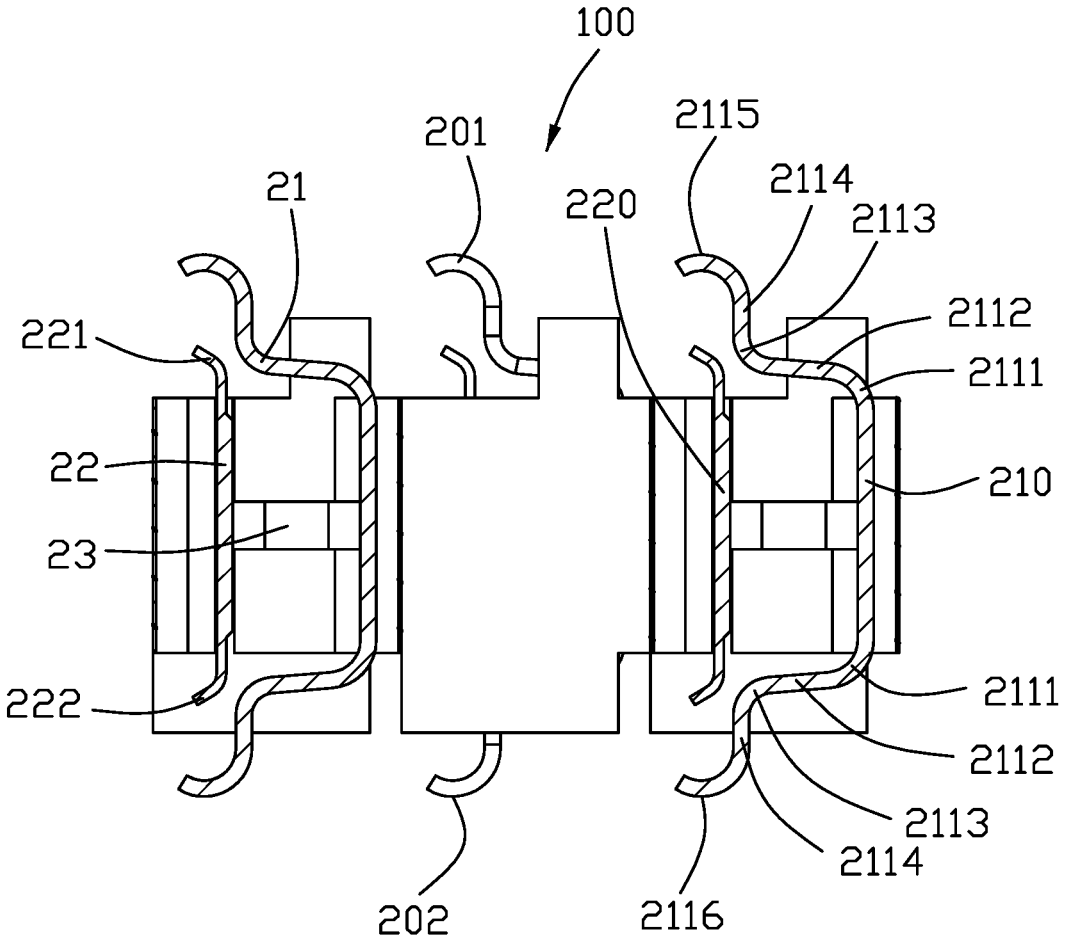
FIG. 10 is a cross-sectional view of the electrical connector of FIG. 5 wherein the contact is in a relaxed manner.
Figure 11:
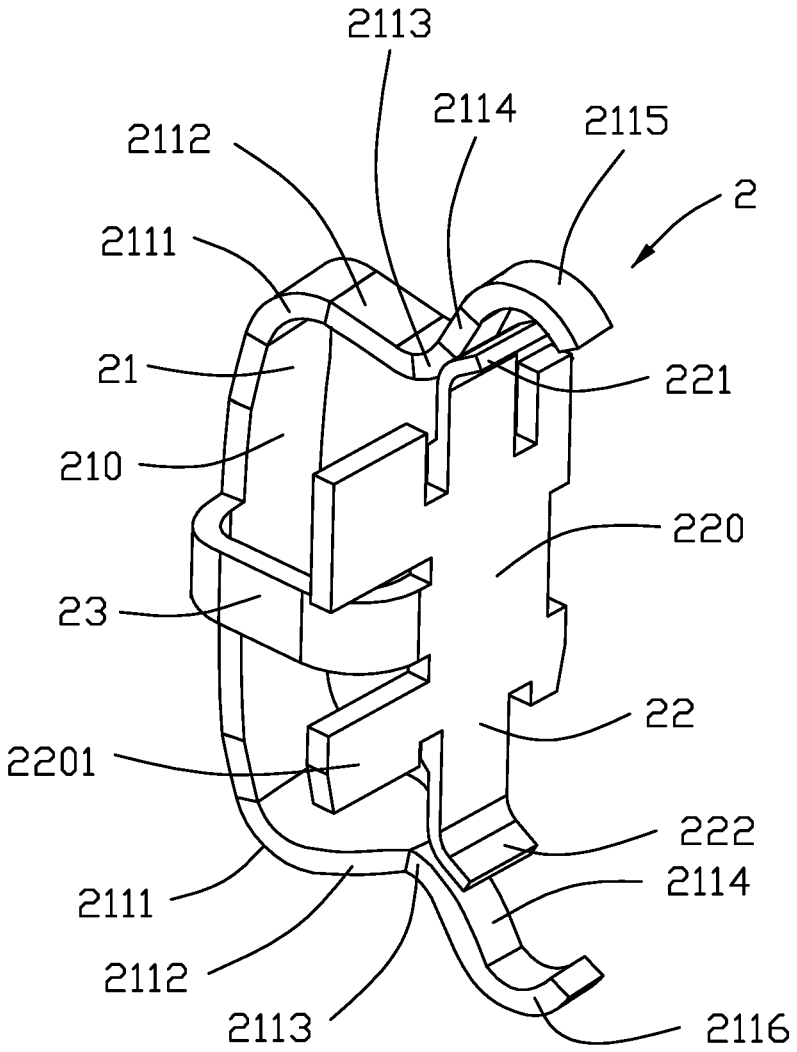
FIG. 11 is a perspective view of the electrical contact of the electrical connector of FIG. 8 wherein the contact is in a compressed manner.

Referring to FIG. 4, the upper mounting arm 12 is disposed at the downside of the upper elastic arm 11 and forms a space therebetween; the lower mounting arm 14 is disposed at the downside of the lower elastic arm 13 and forms a space therebetween. The upper elastic arm 11 and the lower elastic arm 13 are respectively deformed by the chip module 102 and print circuit board 101 to resist to the upper mounting arm 12 and lower mounting arm 14. The upper elastic arm 11 moves downwardly and abuts to the upper abutting portion 122, and the lower elastic arm 13 moves upwardly and abuts to the lower abutting portion 142. The upper and lower elastic arms 11,13 are deformed to abut to the upper and lower mounting arms 12,14, the first, second, third and forth bending portions 111,112,131,132 of the upper and lower elastic arms 11,13 are further bent due to the pressure, the upper and lower contacting portions 113,133 slide along the shape of the upper and lower abutting portions 122,142 to provide a supporting force, therefore, it is possible to prevent the first and third bending portions 111,131 from being excessively deformed by being pressed, to prevent the electrical contact 100 from losing elasticity, and to extend the service life of the electrical contact 100.

When the electrical contact 100 is assembled between the chip module 102 and the circuit board 101, the upper elastic arm 11 is crimped to the upper abutting portion 122 of the upper mounting arm 12, and the lower elastic arm 13 is crimped to the lower abutting portion 142 of the lower mounting arm 14, to form a parallel conductive paths, respectively, to reduce the total impedance value, and to shorten current path of the chip module 102 and the print circuit board 101 comparing with the conventional elastic contact that only transmitting the current through the curved and long arm-shaped elastic arm, thereby improving the high frequency characteristics of the electrical contact 100 and increasing the transmission speed of the electrical terminals.

Referring to FIGS. 5-13, the electrical connector 100 for connecting a CPU (Central Processing Unit) and a printed circuit board (both not shown), includes an insulative housing 1, a plurality of passageways 10 formed in the housing 1, and a plurality of contacts 2 received within the corresponding passageways 10, respectively. The housing 1 forms a top surface 11 and a bottom surface 12 opposite to each other in a vertical direction. The passageways 10 extend through both the top surface 11 and the bottom surface 12. The contact 2 includes a deflectable section 21 having a main body 210 and opposite upper spring/elastic arm 211 and lower spring/elastic arm 212 respectively located at opposite upper and lower ends of the deflectable section 21. The upper spring arm 211 and the lower spring arm 212 are respectively connected to the CPU and the printed circuit board. The contact 2 further includes a retaining section 22 linked to the deflectable section 21 via a bridge 23. The retaining section 22 is located between the upper spring arm 211 and the lower spring arm 212 with corresponding gaps therebetween in the vertical direction while such gaps will disappear when the upper spring arm 211 and the lower spring arm 212 are deflected by the CPU and the printed circuit board when the contact 2 is in a compressed manner. Generally speaking, the contact 2 forms a top side 201 extending beyond the top surface 11 for contacting the CPU, and a lower side 202 extending beyond the lower surface 12 for contacting the printed circuit board.

The retaining section 22 includes a main base 220 and opposite upper support/mounting arms 221 and lower support/mounting arm 222 respectively located at two opposite upper and lower ends of the main base 220. Notably, during compression, the upper spring arm 211 contacts the upper support arm 221, and the lower spring arm 212 contacts the lower support arm 222. The bridge 23 is linked between the main body 210 of the deflectable section 21 and the main base 220 of the retaining section 22. The upper spring arm 211 includes a first (upper) bending section 2111 linked to the main body 210, an (upper) horizontal section 2112 extending from the first (upper) bending section 2111 toward the main base 220, a second (upper) bending section 2113 extending upwardly from the (upper) horizontal section 2112, an (upper) vertical/abutment section 2114 extending upwardly from the second (upper) bending section 2113, and an upper contacting section 2115 extending from the (upper) vertical section 2114 toward the main base 220. Symmetrical to the upper spring arm 211, the lower spring arm 212 included a first (lower) bending section 2111, a (lower) horizontal section 2112, a (lower) second bending section 2113, a (lower) vertical/abutment section 2114, and a lower contacting section 2116 arranged in a mirror image manner with the upper spring arm 211.

The housing 1 forms upper standoffs 110 on the top surface 11 and lower standoffs 120 on the bottoms surface 12. The upper spring arm 211 extends upwardly beyond the upper standoffs 110, and the lower spring arm 212 extends downwardly beyond the lower standoffs 120. The upper support arm 221 is located between the top surface 11 and the upper standoffs 110, and the lower support arm 222 is located between the bottom surface 12 and the lower standoffs 120. When the CPU and the printed circuit board are respectively positioned upon the uppers standoffs 110 and the lower standoffs 120, the upper spring arm 211 and the lower spring arm 212 are respectively deflected and further abut against the corresponding upper support arm 221 and the lower support arm 222, respectively, illustrated later.

The retaining section 22 includes the (planar) main base 220 and the barbs 2201 on two lateral sides for engagement within the passageway 10. The main body 210 and the main base 220 are parallel to each other with the bridge 23 horizontally extending therebetween. The bridge 23 is essentially located at the mid-level of the whole contact 2 so as to have the whole contact 2 symmetrically arranged in the vertical direction. The upper support arm 221 and the lower support arm 222 extend obliquely away from the upper spring arm 211 and the lower spring arm 212 so as to comply with extension configuration of the upper spring arm 211 and that of the lower spring arm 212. In other words, the oblique upper support arm 221 extends not only upwardly but also sideward away from the main base 220 perpendicular to the plane defined by the main base 220. Similarly the oblique lower support arm 212 extends not only downwardly but also sideward away from the main base 220 perpendicular to the plane defined by the main base 220.

When the upper spring arm 211 is downwardly pressed by the CPU, the upper spring arm 211 moves along the upper support arm 221. Similarly, when the lower spring arm 212 is upwardly pressed by the printed circuit board, the lower spring arm 212 moves along the lower support arm 222. In detailed analysis, the (upper) vertical/abutment section 2114 abuts against the upper support arm 221, and the (lower) vertical/abutment section 2114 abuts against the lower support arm 222 so as to assure no yielding around the (upper/lower) first bending section 2111.

From an electrical viewpoint, during operation dual electrical paths are formed between the upper contacting section 2115 and the lower contacting section 2116, of which one is made via the deflectable section 21 only, and the other is made via assistance of the retaining section 22. Notably, the upper spring arm 211 and the lower spring arm 212 along the first electrical path essentially perform the required mechanical characteristics, e.g., provision of the proper normal force, while the upper support arm 221 and the lower support arm 222 along the second electrical path essentially perform the required electrical characteristics, e.g., provision of the shorter path and the lower impedance. The first electrical path and the second electrical path in parallel also help lowering the impedance.

Although the present invention has been described with reference to particular embodiments, it is not to be construed as being limited thereto. Various alterations and modifications can be made to the embodiments without in any way departing from the scope or spirit of the present invention as defined in the appended claims.

Figure 12:
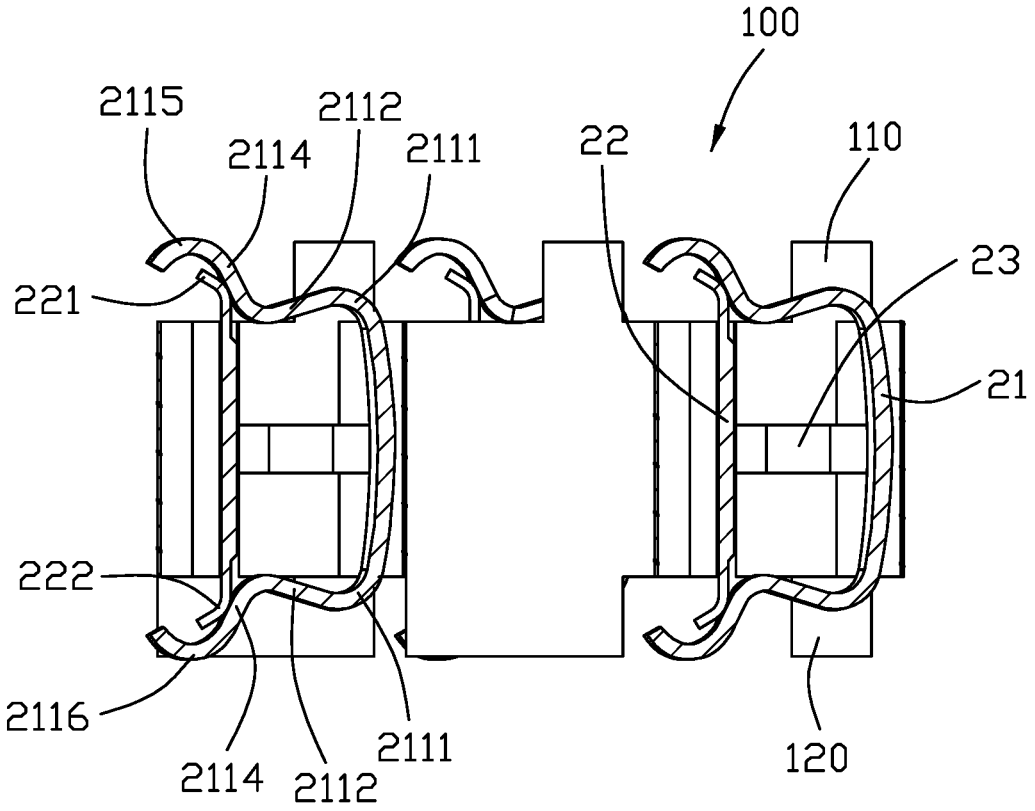
FIG. 12 is a cross-sectional view of the electrical connector of FIG. 5 wherein the contact is in the compressed manner.
Figure 13:
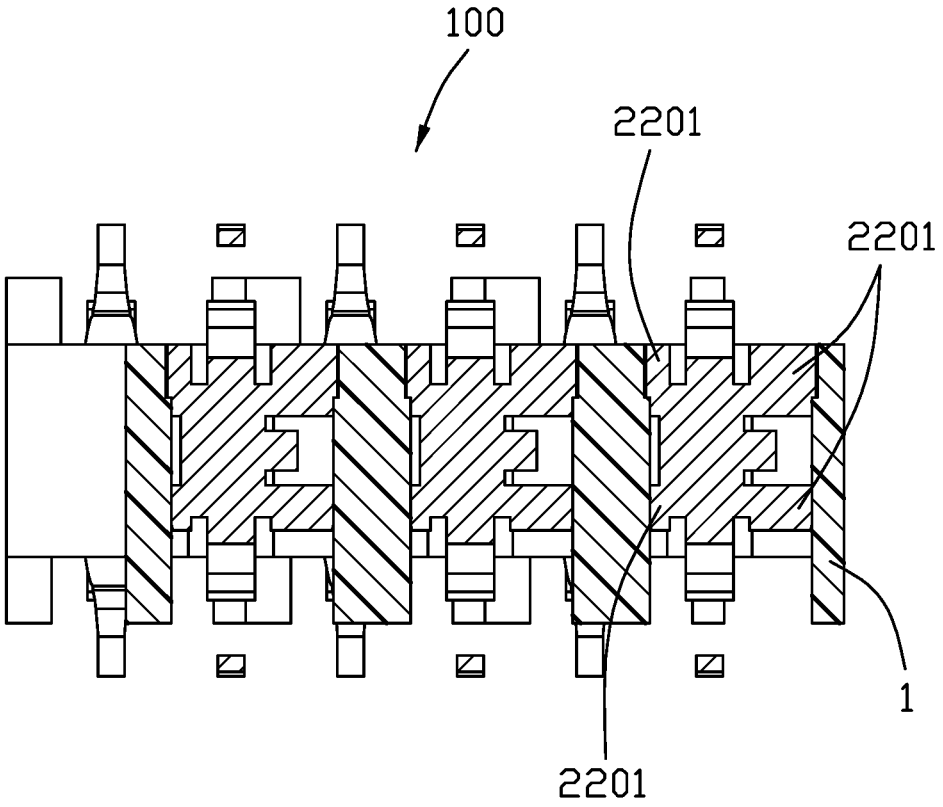
FIG. 13 is another cross-sectional view of the electrical connector of FIG. 5 wherein the contact is in the relaxed manner.

Understandably, there are several common features in both the upper embodiment and the second embodiment wherein the upper elastic arm in the first embodiment is analogous to the upper spring arm in the second embodiment, and the upper mounting arm in the first embodiment is analogous to the upper support arm in the second embodiment. Similarly, the lower elastic arm in the first embodiment is analogous to the lower spring arm in the second embodiment, and the lower mounting arm in the first embodiment is analogous to the lower support arm in the second embodiment. The main body with barbs on the lateral side edges in the first embodiment is analogous to the main base with barbs on the lateral side edges in the second embodiment. The essentially difference between the first embodiment and the second embodiment is that in the first embodiment the upper elastic arm and the lower elastic arm respectively extend from the main body in an U-shaped configuration while in the second embodiment the upper spring arm and the lower spring arm commonly extend from the main body which is opposite to and connected to the main base via the bridge. Theoretically speaking, in the second embodiment the whole deflection section 21 associated with the bridge 23 can be deemed deflectable or deformable. This is the reason why the deflectable section 21 is curved rather than being planar during operation as shown in FIG. 12. Anyhow, both the first embodiment and the second embodiment disclose the relatively longer elastic arm or spring arm compared with the aforementioned prior design for better mechanical performance and relatively shorter electrical path for better electrical performance.

Understandably, the contact disclosed in the first embodiment is used in an electrical connector having the corresponding housing similar to what is disclosed in the second embodiment. For example, in the first embodiment of FIGS. 1-4 the upper elastic arm 11 includes the first bending portion 111 extending in the sideward direction, and the second bending portion 112 extending in the reversed sideward direction to form the U-shaped configuration for increasing the total length and the associated resiliency thereof. Similarly, in the second embodiment of FIGS. 5-13, the upper spring arm 211 includes the horizontal section 2112 extending in a sideward direction and the bridge 23 extends in a reversed sideward direction for increasing the total length and the associated resiliency thereof. In other words, generally speaking the bridge 23 may be deemed as a part of the upper spring arm 211 because both the deflectable section and the associated bridge 23 are floating. Therefore, in the second embodiment of FIGS. 5-13, the upper spring arm 211 with the associated bridge 23 can be deemed as the upper spring arm unit, corresponding to the upper elastic arm (unit) 11 disclosed in the first embodiment of FIGS. 1-4.

In brief, in both first embodiment of FIGS. 1-4 and the second embodiment of FIGS. 5-13, the total configuration related to the spring or elastic arm unit includes such a back-and-forth structure in the side direction for doubling the length and the corresponding resiliency thereof, wherein said back-and-forth structure refers to the combination of the first bending portion 111 and the second bending portion 112 in the first embodiment of FIGS. 1-4, and to the combination of the horizontal section 2112 and the bridge 23 in the second embodiment of FIGS. 5-13.

What is claimed is:

1. An electrical contact for use within an electrical connector, comprising:

a planar retaining section having a planar main base;

a plurality of barbs formed on opposite lateral side edges of the main base;

an oblique upper support arm and an oblique lower support arm respectively formed on opposite upper and lower ends of the main base in a vertical direction, said upper support arm extending not only upwardly but also sidewardly away from the main base in a sideward direction perpendicular to a plane defined by the main base, and said lower support arm extending not only downwardly but also sideward away from the main base in said sideward direction; and an upper spring arm unit extending from the main base and having an upward upper contacting section and an upper abutment section located around the upper contacting section and compliantly abutting against the upper support arm when the upper spring arm is downwardly compressed, a lower spring arm unit extending from the main base and having a downward lower contacting section and a lower abutment section located around the lower contacting section and compliantly abutting against the lower support arm when the lower spring arm is upwardly compressed; wherein the main base and the barbs thereof are immovable when the upper spring arm is downwardly compressed and the lower spring arm is upwardly compressed.

2. The electrical contact as claimed in claim 1, wherein each of said upper spring arm unit and said lower spring arm unit includes a back-and-forth structure along the sideward direction for increasing a length and corresponding resiliency thereof.

3. The electrical contact as claimed in claim 2, wherein the upper spring arm unit directly extends from an upper end of the main base with a first bending portion and a second bending portion commonly forming the corresponding back-and-forth structure thereof, and the lower spring arm is directly extends from a lower end of the main base with a third bend portion and fourth bending portion commonly forming the corresponding back-and-forth structure.

4. The electrical contact as claimed in claim 3, wherein the upper spring arm unit is located by two lateral sides of upper support arm, and the lower spring arm unit is located by two lateral side of the lower support arm.

5. The electrical contact as claimed in claim 2, wherein the upper spring arm unit and the lower spring arm unit commonly include a deflectable section linked to the main base via a sidewardly extending bridge therebetween, an upper horizontal section cooperates with the bridge to commonly form the back-and-forth structure of the upper spring arm unit and a lower horizontal section cooperates with the bridge to commonly form the back-and-forth structure of the lower spring arm unit.

6. The electrical contact as claimed in claim 5, wherein the deflectable section is spaced from and opposite to the main base in said sideward direction, and said bride is located at a mid-level with regard to both the deflectable section and the main base.

7. An electrical contact assembly comprising:

an insulative housing forming at least one passage therein;

a contact retained in the passageway and comprising:

a retaining section including a planar main base with barbs on two opposite lateral side edges thereof in a lateral direction;

opposite upper support arm and lower support arm respectively formed on opposite upper and lower ends of the main base in a vertical direction perpendicular to the lateral direction;

a deflectable section having a main body spaced from and opposite to the main base in a sideward direction perpendicular to both the lateral direction and the vertical direction;

an upper spring arm extending from an upper side of the main body with an upward upper contacting section and an upper abutment section located around the upper contacting section and abutting against the upper support arm when the upper spring arm is downwardly compressed; and a lower spring arm extending from a lower side of the main body with a downward lower contacting section and a lower abutment section located around the lower contacting section and abutting against the lower support arm when the lower spring arm is upwardly compressed; wherein a bridge is connected between the main base and the main body in the sideward direction; wherein the main base and the barbs thereof are immovable with regard to the housing when the upper spring arm is downwardly compressed and the lower spring arm is upwardly compressed.

8. The electrical contact assembly as claimed in claim 7, wherein said bridge is located at mid-level of both the deflectable section and the retaining section in the vertical direction.

9. The electrical contact assembly as claimed in claim 8, wherein the housing further forms opposite upper standoff and lower standoff on opposite top and bottom surfaces thereof around the passageway, the upper spring arm extends above the upper standoff while the upper support arm extends below the upper standoff, and the lower spring arm extends below the lower standoff while the lower support arm extends above the lower standoff.

10. The electrical contact assembly as claimed in claim 9, wherein the upper support arm extends obliquely in both the vertical direction and the sideward direction, and the lower support arm extends obliquely in both the vertical direction and the sideward direction.

11. The electrical contact as claimed in claim 1, wherein the upper support arm extends away from the upper spring arm in the sideward direction, and the lower support arm extends away from the lower spring arm in the sideward direction.

12. The electrical contact assembly as claimed in claim 7, wherein the upper support arm extends away from the upper spring arm in the sideward direction, and the lower support arm extends away from the lower spring arm in the sideward direction.

13. An electrical contact assembly comprising:

an insulative housing forming at least one passage therein;

a contact retained in the passageway and comprising:

a retaining section including a planar main base with barbs on two opposite lateral side edges thereof in a lateral direction;

opposite upper support arm and lower support arm respectively formed on opposite upper and lower ends of the main base in a vertical direction perpendicular to the lateral direction;

an upper spring arm moveable around the upper support arm and equipped with an upward upper contacting section and an upper abutment section located around the upper contacting section and abutting against the upper support arm when the upper spring arm is downwardly compressed; and a lower spring arm moveable around the lower support arm and equipped with a downward lower contacting section and a lower abutment section located around the lower contacting section and abutting against the lower support arm when the lower spring arm is upwardly compressed; wherein a pair of carriers extend upwardly from an upper end of the main base in a coplanar manner and are located by two opposite sides of the upper support arm in the lateral direction.

14. The electrical contact assembly as claimed in claim 13, wherein the main base and the barbs thereof are immovable with regard to the housing when the upper spring arm is downwardly compressed and the lower spring arm is upwardly compressed.

15. The electrical contact assembly as claimed in claim 13, wherein the upper support arm extends away from the upper spring arm in a sideward direction perpendicular to both the vertical direction and the lateral direction, and the lower support arm extends away from the lower spring arm in the sideward direction.

16. The electrical contact assembly as claimed in claim 13, wherein the upper spring arm directly extends from the upper end of the main base and the lower spring arm extends from a lower end of the main base.

17. The electrical contact assembly as claimed in claim 16, wherein the upper spring arm extends directly by two sides of the upper support am in the lateral direction, and the lower spring arm extends directly by two opposite sides of the lower support arm in the lateral direction.

18. The electrical contact assembly as claimed in claim 13, wherein the upper spring arm extends indirectly from the main base via a deflectable section having a main body opposite to the main base in a sideward direction perpendicular to both the vertical direction and the lateral direction, and the lower spring arm indirectly extends from the main base via said deflectable section.

19. The electrical contact assembly as claimed in claim 18, wherein the upper spring arm extends directly from an upper end of the main body and the lower spring arm extends directly from a lower end of the main body.

20. The electrical contact assembly as claimed in claim 19, wherein the main body and the main base are connected via a bridge therebetween.

* * * * *